US010683758B2

(12) United States Patent
Sehra et al.

(10) Patent No.: US 10,683,758 B2
(45) Date of Patent: Jun. 16, 2020

(54) INTER-STAGE COOLING FOR A TURBOMACHINE

(71) Applicant: ROLLS-ROYCE plc, London (GB)

(72) Inventors: Gurmukh S. Sehra, Walsall (GB); Philip D. Thatcher, Derby (GB); Iain C. Gardner, Derby (GB)

(73) Assignee: ROLLS-ROYCE PLC, London (GB)

( * ) Notice: Subject to any disclaimer, the term of this patent is extended or adjusted under 35 U.S.C. 154(b) by 218 days.

(21) Appl. No.: 15/651,224

(22) Filed: Jul. 17, 2017

(65) Prior Publication Data

US 2018/0045054 A1 Feb. 15, 2018

(30) Foreign Application Priority Data

Aug. 15, 2016 (GB) ..... 1613926.3

(51) Int. Cl.
*F01D 5/08* (2006.01)
*F01D 9/06* (2006.01)
(Continued)

(52) U.S. Cl.
CPC ..... *F01D 5/081* (2013.01); *F01D 5/082* (2013.01); *F01D 9/041* (2013.01); *F01D 9/065* (2013.01);
(Continued)

(58) Field of Classification Search
CPC ..... F01D 5/081; F01D 5/082; F01D 9/065; F01D 9/041; F01D 11/001; F01D 25/08;
(Continued)

(56) References Cited

U.S. PATENT DOCUMENTS 3,275,294 A * 9/1966 Allen ..... F01D 5/081 415/115
3,945,758 A * 3/1976 Lee ..... F01D 5/187 415/144
(Continued)

FOREIGN PATENT DOCUMENTS

GB 1484951 A 9/1977
GB 1540353 A 2/1979
WO 2015/112227 A2 7/2015

OTHER PUBLICATIONS

Dec. 14, 2017 Search Report issued in European Patent Application No. 17181631.
(Continued)

*Primary Examiner* — Grant Moubry
(74) *Attorney, Agent, or Firm* — Oliff PLC

(57) ABSTRACT

An apparatus for controlling flow of coolant into an inter-stage cavity of a turbomachine is described. The cavity is bounded by a first turbine stage, a second turbine stage axially displaced along a common axis of rotation with the first turbine stage, and an annular platform bridging a space between the axially displaced first and second turbine stages. An annular plenum chamber is arranged inboard of the annular platform, the annular plenum chamber having one or more inlets for receiving coolant and one or more outlets exiting into the cavity, whereby, in use, coolant is delivered into the cavity at an increased pressure compared to coolant entering the plenum chamber at the inlet. The apparatus is beneficially arranged immediately upstream (with respect to the flow of a working fluid through the turbomachine) of an inter-stage seal assembly.

15 Claims, 8 Drawing Sheets

(51) Int. Cl.
*F01D 9/04* (2006.01)
*F01D 11/00* (2006.01)

(52) U.S. Cl.
CPC ..... *F01D 11/001* (2013.01); *F05D 2220/32* (2013.01); *F05D 2240/128* (2013.01); *F05D 2240/24* (2013.01); *F05D 2240/55* (2013.01); *F05D 2260/20* (2013.01)

(58) Field of Classification Search
CPC .. F01D 25/12; F05D 2240/24; F05D 2240/55; F05D 2240/128; F05D 2260/20; F05D 2220/32
See application file for complete search history.

(56) References Cited

U.S. PATENT DOCUMENTS 4,113,406 A 9/1978 Lee et al.
4,314,793 A * 2/1982 DeTolla ..... F01D 11/005 415/135
4,551,064 A * 11/1985 Pask ..... F01D 11/08 415/115
5,749,701 A 5/1998 Clarke et al.
7,507,069 B2 * 3/2009 Kizuka ..... F01D 5/081 415/199.5
8,162,598 B2 * 4/2012 Liang ..... F01D 11/005 415/115
8,240,980 B1 * 8/2012 Liang ..... F01D 11/08 415/115
8,740,554 B2 * 6/2014 Virkler ..... F01D 5/3015 415/173.7
9,017,013 B2 * 4/2015 Laurello ..... F01D 5/087 415/115
9,062,557 B2 * 6/2015 Tham ..... F01D 11/001
9,316,153 B2 * 4/2016 Patat ..... F01D 9/065
9,631,515 B2 * 4/2017 Oyarbide ..... F01D 25/12
10,167,723 B2 * 1/2019 Suciu ..... F02C 3/04

OTHER PUBLICATIONS

Jan. 17, 2017 Search Report issued in British Patent Application No. 1613926.3.

* cited by examiner

Figure 8a
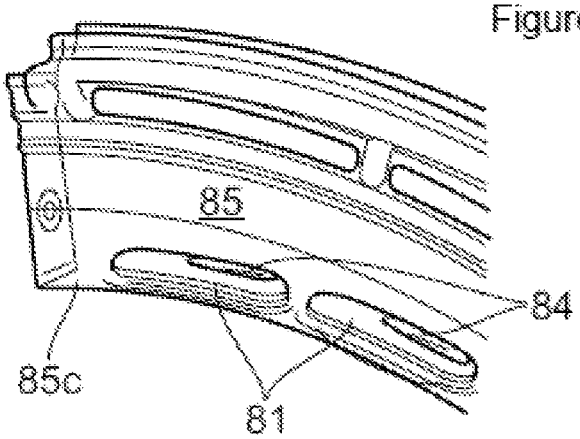
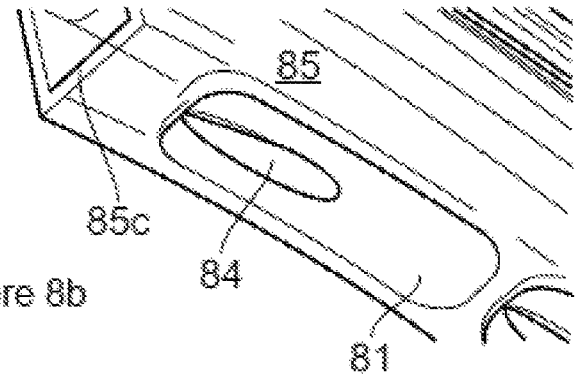
Figure 8b
Figure 8c
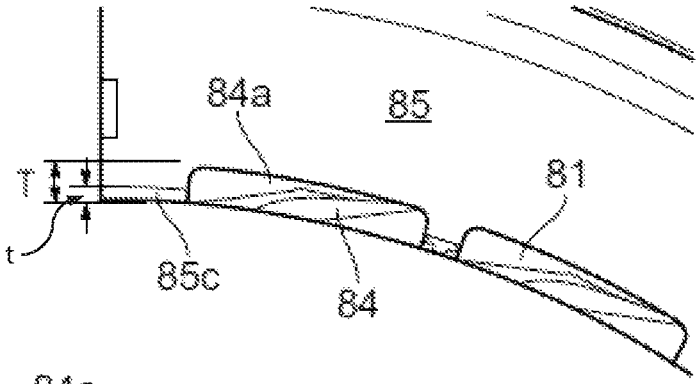
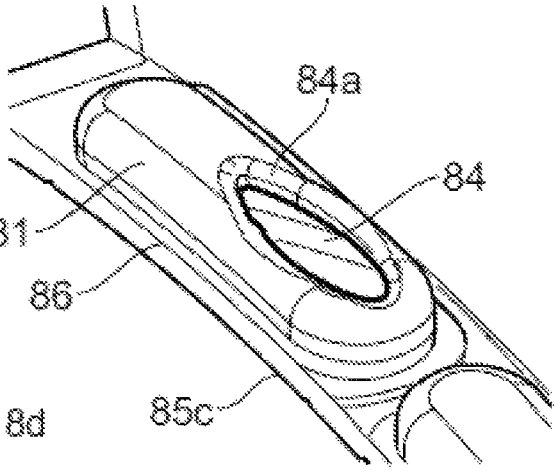
Figure 8d

INTER-STAGE COOLING FOR A TURBOMACHINE

FIELD OF THE INVENTION

The present invention relates to cooling between stages of a turbomachine. For example, but without limitation, the invention is concerned with inter-stage cooling between turbine stages in an axial flow gas turbine engine.

BACKGROUND TO THE INVENTION

FIG. 1 shows a gas turbine engine as is known from the prior art. With reference to FIG. 1, a gas turbine engine is generally indicated at 100, having a principal and rotational axis 11. The engine 100 comprises, in axial flow series, an air intake 12, a propulsive fan 13, a high-pressure compressor 14, combustion equipment 15, a high-pressure turbine 16, a low-pressure turbine 17 and an exhaust nozzle 18. A nacelle 20 generally surrounds the engine 10 and defines the intake 12.

The gas turbine engine 100 works in the conventional manner so that air entering the intake 12 is accelerated by the fan 13 to produce two air flows: a first air flow into the high-pressure compressor 14 and a second air flow which passes through a bypass duct 21 to provide propulsive thrust. The high-pressure compressor 14 compresses the air flow directed into it before delivering that air to the combustion equipment 15.

In the combustion equipment 15 the air flow is mixed with fuel and the mixture combusted. The resultant hot combustion products then expand through, and thereby drive the high and low-pressure turbines 16, 17 before being exhausted through the nozzle 18 to provide additional propulsive thrust. The high 16 and low 17 pressure turbines drive respectively the high pressure compressor 14 and the fan 13, each by suitable interconnecting shaft.

It is known that turbine engine efficiency is closely related to operational temperatures and acceptable operational temperatures are dictated to a significant extent by the material properties of the components. With appropriate cooling it is possible to operate these components near to and occasionally exceeding the melting points for the materials from which they are constructed in order to maximise operational efficiency.

Generally, coolant air is taken from the compressor stages of a gas turbine engine. This drainage of compressed air reduces the quantity available for combustion and consequently, engine efficiency. It is desirable to use coolant air flows as effectively as possible in order to minimise the necessary coolant flow to achieve a desired level of component cooling for operational performance. Intricate coolant passageways are provided within engine components and are arranged to provide cooling. The coolant passes through these passageways and is typically delivered to cavities in regions requiring cooling. Delivery into a cavity is often by nozzle projection which serves to create turbulence with hot gas flows for a diluted cooling effect.

One area where compressed coolant air is known to be used is between stages in a gas turbine engine. The coolant air is typically delivered into a cavity between discs of adjacent turbine stages. The discs may be rotor discs. The cavity may be positioned radially inwardly of a stationary nozzle guide vane which is arranged axially (i.e along the engine axis) between the discs. The coolant may be swirled to complement the direction and speed of rotation of a rotor disc on delivery to the disc surface.

A prior art arrangement is shown in FIG. 2 which is a schematic cross-section of a prior cooling arrangement for a turbine inter-stage. As shown, first blade 1 forms a shank with a locking plate 2 presented across the root 3 of the blade 1. Seals 4 are provided in the form of a labyrinth seal arrangement with coolant airflow (compressed air which has bypassed the combustor) in the direction of arrowhead 5. The coolant air travels radially outwardly (upwardly in the view shown) and into the cavity 6 formed between the mounting disc 7 for the blade 1 and the bottom of a nozzle guide vane dividing the axially adjacent turbine stages. As can be seen there is a gap 8 through which hot gas is ingested into the cavity 6. The coolant air 5 has been arranged to prevent excessive hot gas ingestion, the direction of which is represented by arrowhead 9. This can be achieved by appropriate balancing of pressures between the hot gas and coolant in the region. The locking plate 2 acts to secure location of the blade shank 1 such that coolant flow 5 is contained or at least restricted below the blade shank 1. An area 10 adjacent the lock plate 2 allows coolant air to flow across it at its surface to provide cooling. The lock plate 2 is segmented, the gaps between the segments allowing coolant leakage into the cavity 6. It will be understood that unwanted hot gas ingestion occurs when the coolant flow supplied to the rim gap is less than the critical value required to seal the rim gap. In the case of an inter-stage seal cavity where the labyrinth seal clearance is such that the cooling flow is drawn off to the lower pressure "sink", downstream of the stage nozzle guide vane, leaving the gap at the rear of the upstream rotor short of the necessary flow requirements to create the seal at the annulus. Thus, as engines complete more and more service cycles and the inter-stage seals tend to wear there is also an increase in the clearances and redistributing the normally fixed level of coolant flow towards the rear stator well. This increases the risk of hot gas ingestion in the front of the well. Thus, pressure differentials between the coolant flow and hot gas need to be carefully controlled if engine efficiency is to be optimised.

There is a balance between the cooling supply and hot gas ingestion dependent upon many factors including the static pressure in the gas turbine annulus, the losses in the cooling air feed system, any flow dependent on a vortex, rotating hole, clearance diameters or seal clearance subject to a combination of rotor speeds, the main annulus pressure ratios and transient effects such as seal clearances. In such circumstances, a range of conditions over which hot gas ingestion may occur and the level of ingestion will vary.

With ever increasing engine size and higher operating temperatures and engine speeds, pressure losses in the air system increase and coolant flows become less effective and more difficult to control. There is a desire to further improve efficiency of flow of cooling air.

STATEMENT OF THE INVENTION

In accordance with the invention there is provided an apparatus for controlling flow of coolant into an inter-stage cavity of a turbomachine, the cavity bounded by a first turbine stage, a second turbine stage axially displaced along a common axis of rotation with the first turbine stage, and an annular platform bridging a space between the axially displaced first and second turbine stages, an annular plenum chamber arranged inboard of the annular platform, the annular plenum chamber having one or more inlets for receiving coolant and one or more outlets exiting into the cavity, whereby, in use, coolant is delivered into the cavity with minimal pressure loss.

The apparatus is beneficially arranged immediately upstream (with respect to the flow of a working fluid through the turbomachine) of an inter-stage seal assembly.

The annular platform may form a radially outer wall of the annular plenum chamber. The annular platform may form a hub of a stator. Where the annular platform forms a hub of a stator, the stator may comprise one or more hollow nozzle guide vanes through which coolant may be delivered from an outboard supply of coolant. The one or more inlets may be provided in the annular platform.

The annular plenum chamber may be substantially rectangular in cross section, the rectangle defined by; the annular platform, a radially inner annular wall and a pair of opposed and radially extending chamber walls joining the annular platform to the radially inner annular wall. The one or more outlets may be provided in the radially inner wall. Alternatively, the one or more outlets may be provided in one or both of the radially extending chamber walls. The outlets preferably have a reduced total cross-sectional area compared with the total cross sectional area of the inlets.

In some embodiments, the outlets comprise an annular array of outlet holes. The array may comprise equally spaced outlets arranged around an entire circumference of the annular plenum chamber. The outlet holes may be shaped and/or angled to serve as a nozzle. For example, the outlet holes may vary in diameter as they pass through a wall of the annular plenum chamber. For example, the outlet holes are angled towards one or both of the first and second turbine stage whereby to direct coolant towards radially extending surfaces of the one or both turbine stages. In a circumferential plane, the outlet holes may be angled with respect to a radius extending from the common axis whereby to spin coolant as it exits the annular plenum chamber.

In some embodiments, the outlet holes may be provided in the form of inserts incorporated into a wall of the plenum chamber. For example, such inserts may be welded or brazed into slots or holes included in the wall, alternatively they might be mechanically fastened. The inserts may be built using an additive manufacturing method. For example, but without limitation, the inserts may be built using direct laser deposition (DLD). An advantage of the inserts is that they may be made thicker than the wall of the plenum chamber allowing the thickness (and hence weight) of the plenum chamber walls to be minimised.

By using an additive manufacturing process versus drilling, much greater design freedom for the outlet geometry is provided. Any insert may include one or more outlets which may have the same or different geometries. In some inserts, an outlet is provided with a smoothly curved entrance. In some inserts the hole has a vane shaped cross-section. In some inserts the hole follows a spiral path from its entrance to its exit The annular plenum chamber may be formed from two or more part-annular plenum chamber wall segments bolted together to form the annular plenum chamber.

One or more seals may be provided to separate the cavity from an annular space outboard of the annular platform. For example the seals may include rim seals, the seals may be labyrinth seals.

A seal may be formed integrally with a wall of the annular plenum chamber, for example a discourager seal may be formed integrally with a radially extending wall of the plenum chamber, the discourager seal comprising an axially extending rim. The discourager seal may extend axially upstream. The axially extending rim may include two or more radially outboard circumferential ribs defining a U shaped cross section of the axially extending rim. The U-shaped cross section serves, in use, as a damping cavity, damping peak pressures whereby to minimise ingestion of hot gas into the cooling cavity.

In some embodiments the apparatus further includes an inter-stage seal assembly. The inter-stage seal assembly may be slidably connected to an axially downstream wall of the annular plenum chamber. The slidable connection may comprise radially extending slots in the axially downstream plenum chamber radially extending wall and bolt holes in the interfacing inter-stage seal assembly radially extending face.

The bolt holes and slots arranged in alignment and bolts passed through the slots, washer and spacer and secured into the threaded holes in the interfacing inter-stage seal assembly radially extending face. The inter-stage seal assembly comprises an annular wall and a radially extending wall, the radially extending wall being aligned with and fastened to a radially extending downstream wall of the annular plenum chamber.

The annular wall of the inter-stage seal assembly may include a discourager seal. The discourager seal may comprise a flange extending radially outwardly from the annular wall of the inter-stage seal assembly. The discourager seal may be formed integrally with, or comprise a component fastened to, the remainder of the inter-stage seal assembly. The inter-stage seal assembly may further comprise one or more annular honeycomb seals arranged radially inboard for the annular wall of the inter-stage seal assembly. The inter-stage seal assembly may include an annular recess arranged in a downstream facing, radially extending wall surface close to the annular wall outboard surface for receiving an annular sealing ring. The sealing ring may comprise a W-seal.

An inter-stage seal assembly including a discourager seal may have a substantially U shaped cross section. The U-shaped cross section serves, in use, as a damping cavity. The apparatus may further comprise one or more braid seals arranged in recesses cut into the radially extending wall of the inter-stage seal assembly.

BRIEF DESCRIPTION OF THE DRAWINGS

Embodiments of the invention will now be further described with reference to the accompanying Figures in which:

FIGS. 8*a*, 8*b*, 8*c* and 8*d* show four views (collectively "FIG. 8") of a plenum wall of an embodiment of the invention which incorporates inserts into which the outlet holes of the plenum are embodied.

FIGS. 1 and 2 have been described in detail above.

DETAILED DESCRIPTION OF EMBODIMENTS

Figure 3:
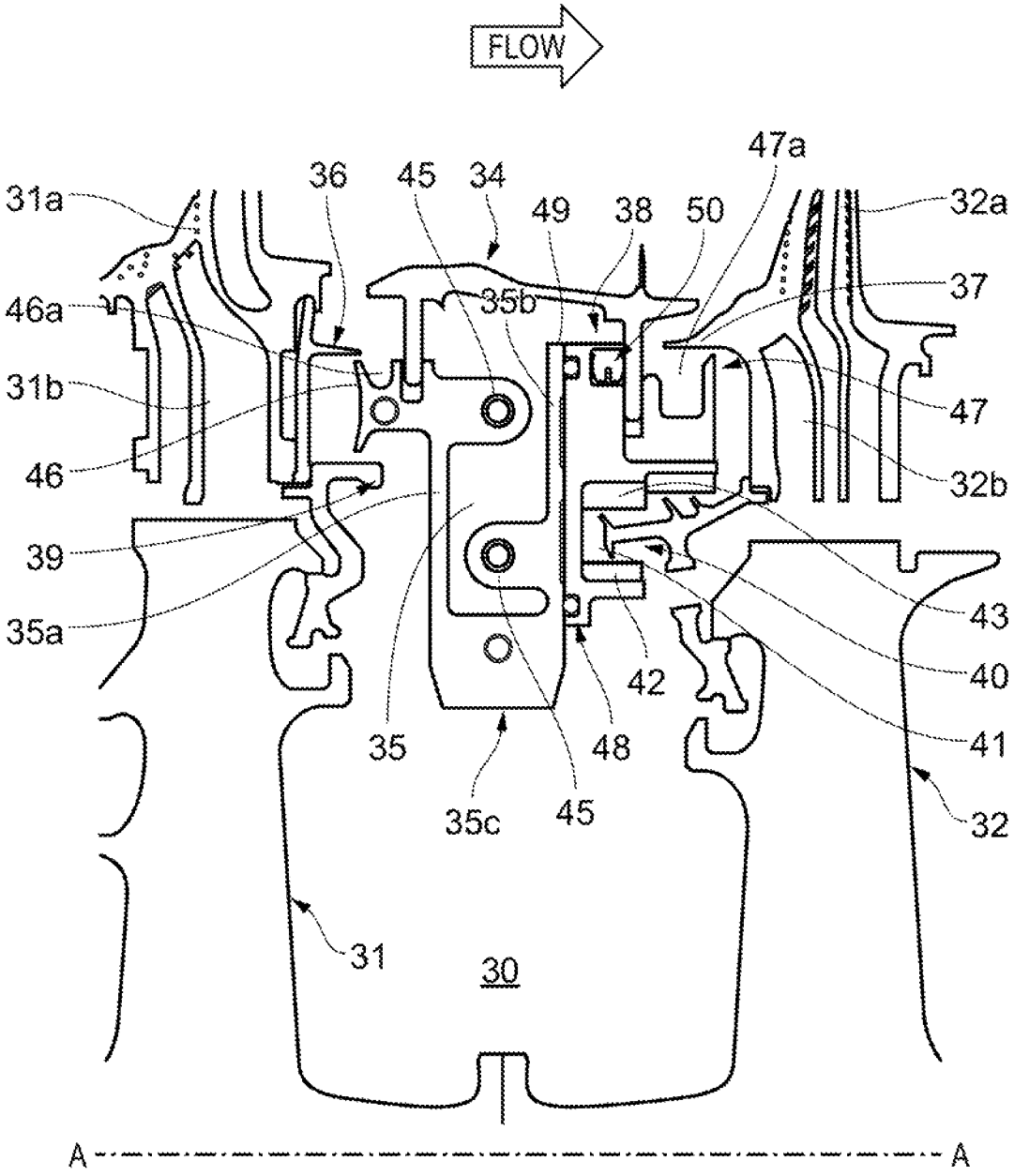
FIG. 3 shows an apparatus in accordance with an embodiment of the invention shown in a sectional view along the engine axis of a turbomachine.
Figure 4:
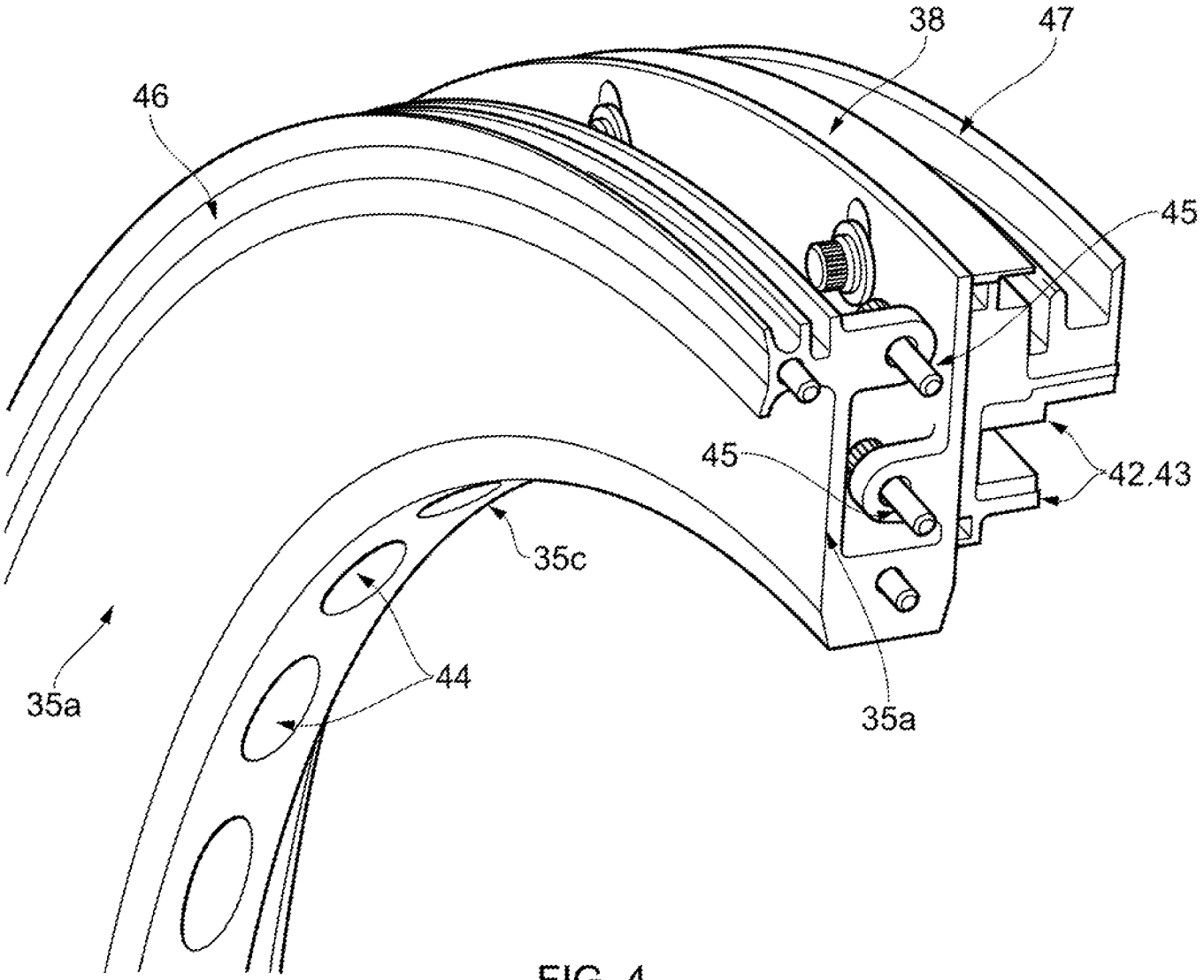
FIG. 4 shows a perspective view of the apparatus of FIG. 3.

As shown in FIGS. 3 and 4, a first turbine stage disc 31 is separated from a second turbine stage disc 32 by an inter-stage cavity 30. Each disc carries a blade 31*a*, 32*a* and the blades and discs are arranged for rotation around an engine axis A-A. Roots of the blades 31*a*, 32*a* contain cooling channels 31*b*, 32*b* which receive cooling air from neighbouring, upstream cavities. Blade 32*a* receives coolant from cavity 30 which sits immediately upstream of the disc 32. An axial gap between the blades 31*a* and 32*a* is bridged by an annular platform 34. Extending radially inboard of the annular platform 34 is an annular plenum chamber 35 bounded by the annular platform 34, radially extending walls 35*a*, 35*b* and radially inner annular wall 35*c*. Rim seals 36 and 37 extend axially from roots of the blades 31*a*, 32*a* and radially inwardly of the annular platform 34. An inter-stage seal assembly 38 sits immediately downstream of the annular plenum chamber 35. A rim seal 39 bridges a radial space between the first turbine stage blade 31*a* and the first turbine disc 31 and extends axially in parallel with rim seal 36. A labyrinth seal 40 extends from a root of the second turbine stage blade 32*a* into a circumferential recess 41 of the inter-stage seal assembly 38 blocking ingress of hot working fluid from the main flow (represented by the outline arrow at the top of the figure) from ingress into the coolant cavity 30 but allowing coolant to be channeled from the cavity 30 and into the blade cooling channels 32*b* to cool the blade 32*a*. Radially inner and outer honeycomb seals 42, 43 line oppositely facing walls of the recess 41.

The FIGS. 3 and 4 show an end of a part-annular segment having a pair of radially aligned bolt flanges 45 having circumferentially extending bolt holes through which bolts can be located to fasten adjacent part-annular segments together to form the annular chamber 35. A first discourager seal 46 extends axially upstream from wall 35*a* of the annular plenum chamber 35. A second discourager seal 47 extends axially downstream of the inter-stage seal assembly 38. The first and second discourager seals 46, 47 sit radially inwardly of the rim seals 36 and 37. The first and second discourager seals 46, 47 each have a substantially U shaped cross-section defining annular spaces 46*a*, 47*a* which serve, in use, as a damping cavity damping peak pressures whereby to minimise ingestion of hot gas into the cooling cavity 30.

Radially inner and outer braid seals 48, 49 are arranged in circumferential recesses provided in an upstream end wall surface of the inter-stage seal assembly 38 adjacent a downstream end wall 35*b* surface of the plenum chamber 35. A W seal is provided in a circumferential recess radially adjacent an outboard surface of the inter-stage seal assembly 38.

Figure 5:
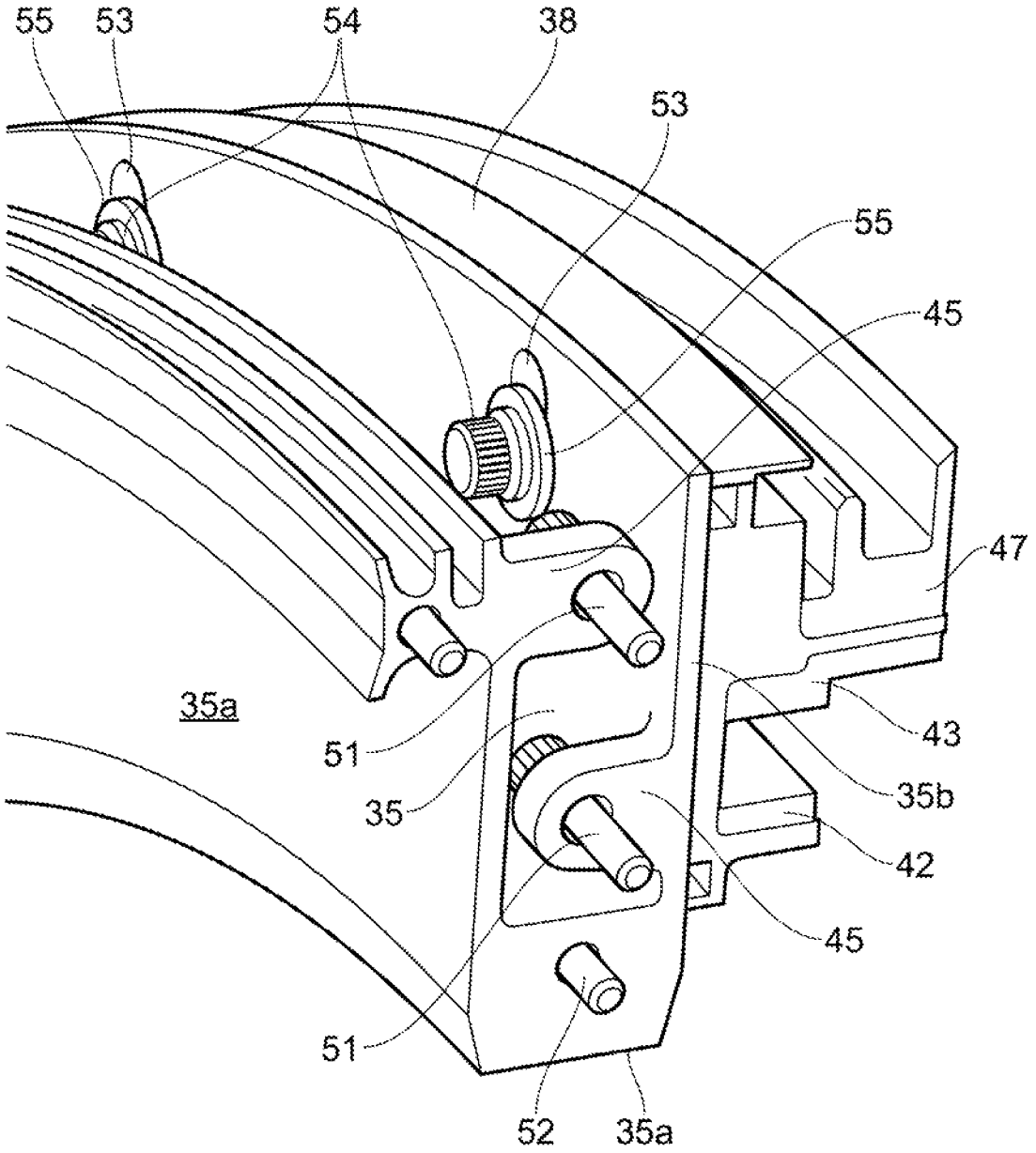
FIG. 5 shows a close up view of FIG. 4 showing a fastening arrangement used to connect the inter-stage seal assembly to the annular plenum chamber of the apparatus.

FIG. 5 shows an enlarged view of an end of part-annular segment of FIGS. 3 and 4. Reference numerals in common with FIGS. 3 and 4 refer to the same components as referenced in FIGS. 3 and 4. As can be seen, the radially extending wall on a downstream side of the plenum chamber 35 includes an annular array of oblong slots 53. These are aligned with a similarly arranged array of circular bolt holes (not shown) on the adjacent wall of inter-stage seal assembly 38. Bolts 58 are passed through the aligned slots 53 and bolt holes. On the plenum chamber side of the wall 35*b*, a washer 55 and spacer (not shown) is slid onto the bolt. The slots 53 have a larger dimension extending radially with respect to the engine axis A-A than that of the aligned bolt holes. This allows for differentials in radial expansion and contraction of the plenum chamber and inter-stage seal assembly to be accommodated.

Figure 6:
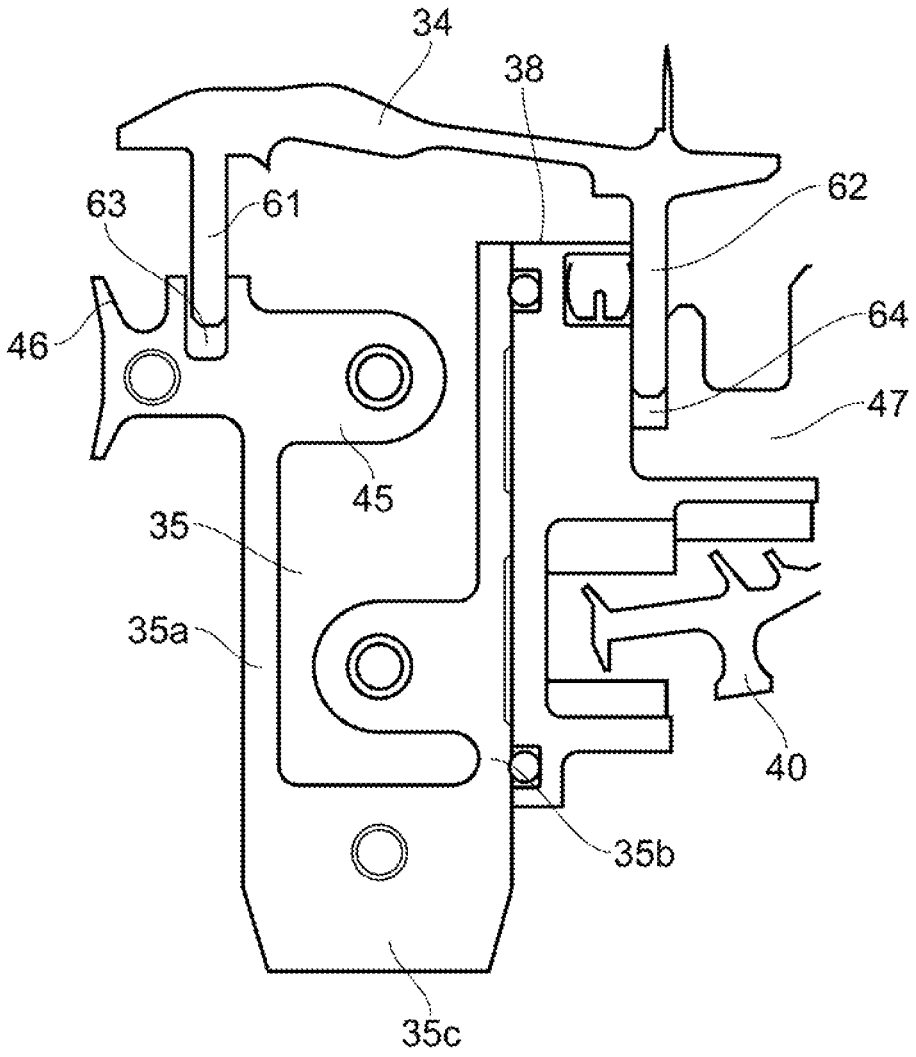
FIG. 6 shows a close up view of FIG. 3 showing the region of the annular platform of FIG. 3.

In FIG. 6 reference numerals in common with FIGS. 3, 4 and 5 refer to the same components as referenced in FIGS. 3, 4 and 5. As can be seen, the annular platform 34 has radially inwardly extending rims 61, 62. The rims 61, 62 are received in radially outboard circumferential recesses arranged adjacent the discourager seals 46, 47. This arrangement allows for differentials in radial expansion and contraction of the annular platform and both the inter-stage seal assembly 38 and the plenum chamber walls 35*a*, 35*b* to be accommodated.

Figure 7:
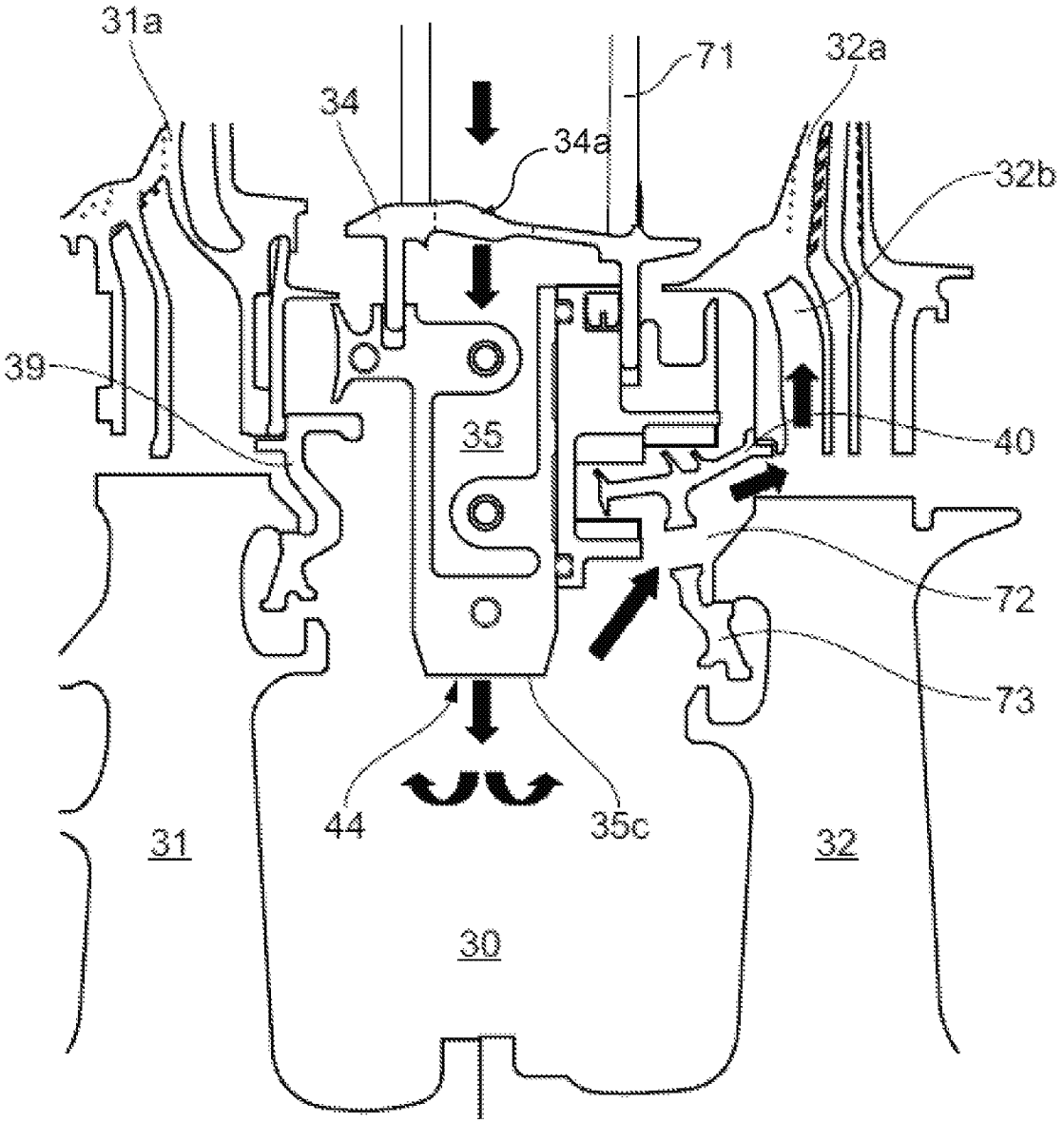
FIG. 7 shows the arrangement of FIG. 3 including additional detail of air flows through the apparatus.

In FIG. 7 reference numerals in common with FIGS. 3, 4, 5 and 6 refer to the same components as referenced in FIGS. 3, 4, 5 and 6. In FIG. 7, the annular platform 34 is a hub of a hollow stator vane 71. Coolant from an outboard supply (not shown) is delivered through the hollow vane 71, through an inlet 34*a* in the annular platform 34 and into the plenum chamber 35. The flow path of the coolant is represented by the block arrows on the Figure. The coolant exits the plenum chamber 35 through outlets 44 in radially inner annular wall 35*c*. Rim seal 39 prevents the coolant from exiting the cavity 30 on the side of the first turbine stage 31, 31*a*. Thus the coolant passes downstream towards second turbine stage 32, 32*a* and through a channel 72 provided in a rim cover plate 73 and is drawn by centrifugal forces into the cooling channel 32*b* and into the body of blade 32*a*. The rim cover plate 73 is integrally formed with the labyrinth seal 40 which prevents ingress of hot gas into the cooling cavity 30.

FIG. 8 shows views of a plenum chamber forming part of an apparatus in accordance with the present invention. As can be seen in the views, a plenum chamber 85 has a radially inner annular wall 85*c* into which a plurality of elongate, circumferentially extending slots 86 are cut. Secured within the slots 81 (for example by welding) are inserts 81. The inserts 81 have been previously built using DLD and have a thickness T which is significantly greater than the thickness t of the radially inner annular wall 85*c*. Inserts have an outlet hole 84 inclined to the surface radially inner annular wall 85*c* and an entrance 84*a* which is smoothly rounded to discourage turbulent flow at the entrance to the outlet hole 84.

It will be understood that the inserts 81 could be positioned instead, or in addition, on a side wall of the plenum chamber 85. Furthermore, such inserts might be used in other applications where design freedom is needed in the shaping of an outlet and where there is value in reducing the weight of a component wall.

Figure 1:
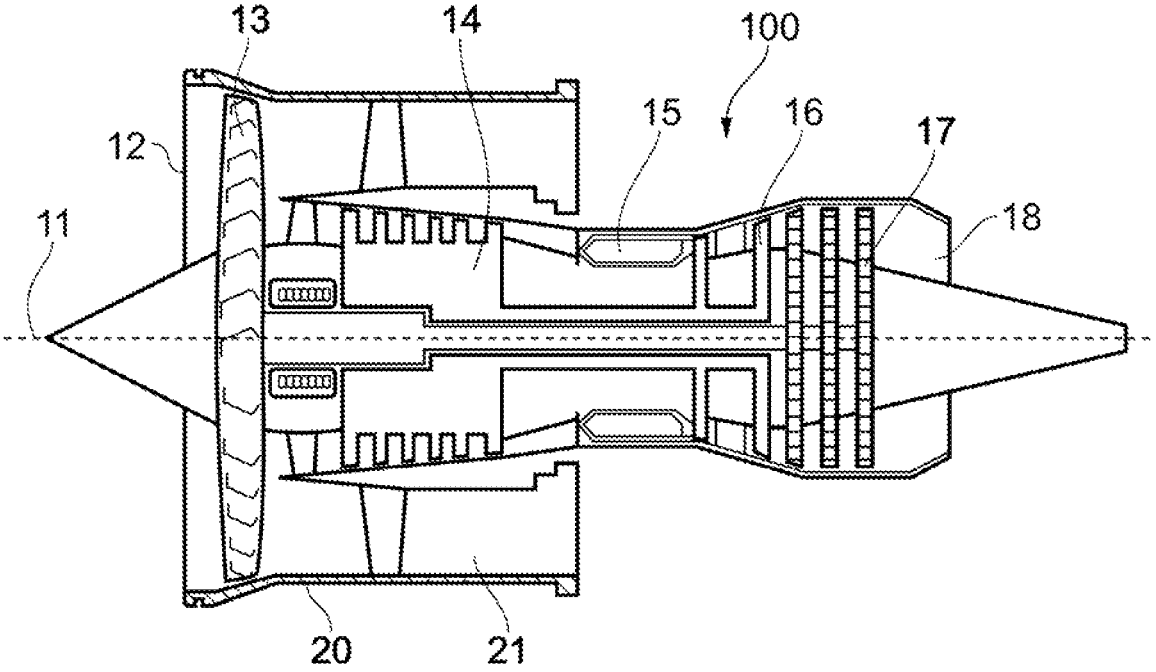
FIG. 1 (Prior Art)
FIG. 1 shows a gas turbine engine as is known from the prior art and into which embodiments of the invention might be incorporated.
Figure 2:
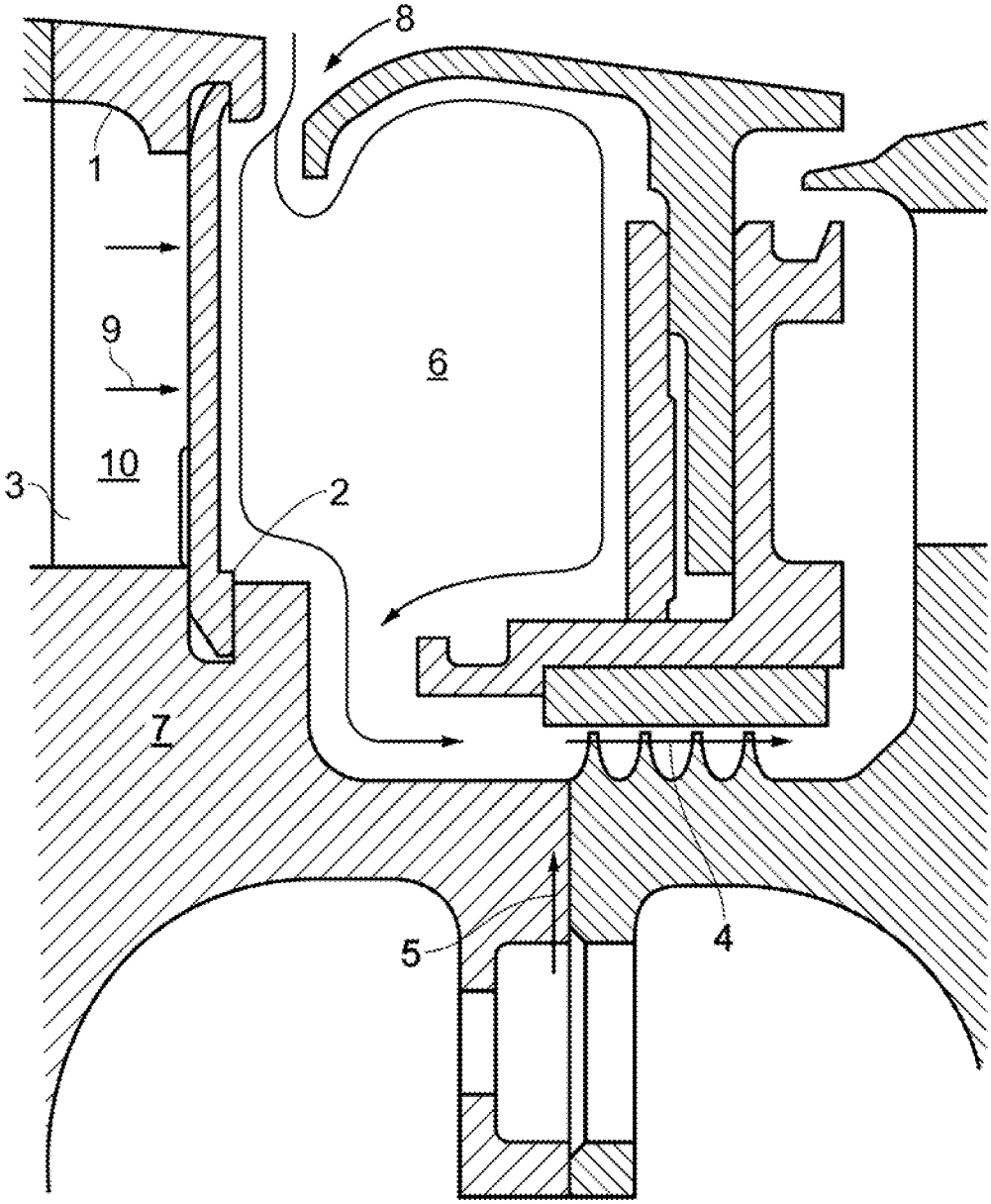
FIG. 2 (Prior Art)
FIG. 2 shows a prior known inter-stage seal and cooling arrangement.

The apparatus of FIGS. 3, 4, 5, 6, 7 and 8 may be incorporated into a gas turbine engine of the configuration of FIG. 1. Other gas turbine engines to which the present disclosure may be applied may have alternative configurations. By way of example such engines may have an alternative number of interconnecting shafts (e.g. three) and/or an alternative number of compressors and/or turbines. Further the engine may comprise a gearbox provided in the drive train from a turbine to a compressor and/or fan.

It will be understood that the invention is not limited to the embodiments above-described and various modifications and improvements can be made without departing from the concepts described herein and claimed in the appended claims. Except where mutually exclusive, any of the features may be employed separately or in combination with any other features and the disclosure extends to and includes all combinations and sub-combinations of one or more features described herein.

The invention claimed is:

1. An apparatus for controlling flow of coolant into an inter-stage cavity of a turbomachine, the cavity bounded by a disc of a first turbine stage, a disc of a second turbine stage axially displaced along a common axis of rotation with the first turbine stage, and an annular platform bridging a space between the axially displaced first and second turbine stages, the apparatus comprising:

an annular plenum chamber arranged inboard of the annular platform, the annular plenum chamber having one or more inlets for receiving coolant and one or more outlets exiting into the cavity; and an inter-stage seal assembly arranged immediately axially downstream of the annular plenum chamber, with respect to flow of a working fluid through the turbomachine when in use, wherein the inter-stage seal assembly is slidably connected to an axially downstream radially extending wall of the annular plenum chamber, and wherein a total cross-sectional area of all of the one or more outlets is less than a total cross-sectional area of the inlets such that the annular plenum chamber is configured to minimize pressure losses of the coolant being delivered to the cavity.

2. The apparatus as claimed in claim 1, wherein the inter-stage seal assembly further comprises one or more annular honeycomb seals arranged radially inboard of an annular wall of the inter-stage seal assembly.

3. The apparatus as claimed in claim 1, wherein a discourager seal is formed integrally with a radially extending wall of the annular plenum chamber, the discourager seal comprising an axially extending rim extending in an axially upstream direction.

4. The apparatus as claimed in claim 3, wherein the axially extending rim has a U shaped cross section configured to serve as a damping cavity damping peak pressures whereby to minimise ingestion of hot gas into the cooling cavity.

5. The apparatus as claimed in claim 1, wherein the annular platform forms a radially outer wall of the annular plenum chamber.

6. The apparatus as claimed in claim 1, wherein the annular platform forms a hub of a stator, the stator comprising one or more hollow nozzle guide vanes through which coolant may be delivered from an outboard supply of coolant and the one or more inlets are provided in the annular platform.

7. The apparatus as claimed in claim 1, wherein the annular plenum chamber is substantially rectangular in cross section, the rectangle defined by; the annular platform, a radially inner annular wall and a pair of opposed and radially extending chamber walls joining the annular platform to the radially inner annular wall.

8. The apparatus as claimed in claim 7, wherein the one or more outlets are provided in the radially inner wall.

9. The apparatus as claimed in claim 1, wherein the outlets comprise an annular array of outlet holes equally spaced around an entire circumference of the annular plenum chamber.

10. The apparatus as claimed in claim 9, wherein the outlet holes are shaped and/or angled to serve as a nozzle.

11. The apparatus as claimed in claim 1, wherein the slidable connection comprises radially extending slots in one of the inter-stage seal assembly radially extending wall and the axially downstream wall of the plenum chamber and bolt holes in the other of the inter-stage seal assembly radially extending wall and the axially downstream wall of the plenum chamber, the bolt holes and slots arranged in alignment and bolts passed through the aligned bolt-holes and slots, the bolts secured by a top hat spacer and a nut.

12. The apparatus as claimed in claim 11, wherein the inter-stage seal assembly comprises an annular wall and a radially extending wall, the radially extending wall being aligned with and fastened to a radially extending wall of the annular plenum chamber.

13. The apparatus as claimed in claim 12, wherein the annular wall of the interstage seal assembly includes a discourager seal.

14. The apparatus as claimed in claim 1, wherein the outlet holes are embodied in inserts secured in slots provided in a wall of the plenum chamber.

15. A gas turbine engine comprising at least two turbine stages separated by an axially extending space and including the apparatus of claim 1 arranged to bridge the axially extending space.

* * * * *